US005341752A

United States Patent [19]

Hambleton

[11] Patent Number: 5,341,752

[45] Date of Patent: Aug. 30, 1994

[54] SECURITY SAFE WITH IMPROVED DOOR LOCKING FEATURES

[76] Inventor: Brian Hambleton, 47 Ridge Rd., Boulder, Colo. 80303

[21] Appl. No.: 151,465

[22] Filed: Nov. 12, 1993

Related U.S. Application Data

[63] Continuation of Ser. No. 893,442, Jun. 4, 1992, abandoned.

[51] Int. Cl.[5] ..... G05G 1/04

[52] U.S. Cl. ..... 109/59 R; 292/36; 70/118

[58] Field of Search ..... 109/59 R; 292/33, 34, 292/36, 37; 70/118–120

[56] References Cited

U.S. PATENT DOCUMENTS

| | | | |
|---|---|---|---|
| 1,366,706 | 1/1921 | Schoell | 70/120 |
| 3,489,450 | 1/1970 | Horikoshi | 292/335 |
| 3,621,686 | 11/1971 | Klein | 292/335 |
| 4,470,277 | 9/1984 | Uyeda | 292/34 |
| 4,671,086 | 6/1987 | Fogleman et al. | 292/144 |
| 4,926,664 | 5/1990 | Gartner et al. | 70/119 |

FOREIGN PATENT DOCUMENTS

| | | | |
|---|---|---|---|
| 614149 | 12/1960 | Italy | 70/120 |
| 2199362 | 6/1988 | United Kingdom | 292/34 |

*Primary Examiner*—Peter M. Cuomo

*Assistant Examiner*—Darnell M. Boucher

*Attorney, Agent, or Firm*—John R. Flanagan

[57] ABSTRACT

A security safe includes a housing having an annular portion defining an opening to an interior cavity, a door mounted to the annular portion for movement between opened and closed positions relative to the opening and having an interior side facing the interior cavity, an improved lock and boltworks mechanism mounted on the door, and an improved arrangement for hingedly mounting the door to the annular portion of the housing. The lock and boltworks mechanism includes a coupler member mounted on the interior side of the door and reciprocally and linearly movable between first and second positions so as to concurrently move a plurality of lock members between locked and unlocked positions in response thereto. The lock and boltworks mechanism also includes an arrangement for causing movement of the coupler member from the second to first position to cause movement of the lock members to their locked positions automatically in response to the door moving from the opened to closed position. The door mounting arrangement includes a pair of slidably mounted hinge members pivotally coupling the door to the housing and having elements accessible from the interior side of the door in order to move the hinge members from the door mounting to door releasing positions without the use of tools.

14 Claims, 2 Drawing Sheets

SECURITY SAFE WITH IMPROVED DOOR LOCKING FEATURES

This application is a continuation of application Ser. No. 07/893,442, filed Jun. 4, 1992, now abandoned.

BACKGROUND OF THE INVENTION

1. Field of the Invention

The present invention generally relates to security chests and safes and, more particularly, is concerned with improved door mounting and locking features in a security safe.

2. Description of the Prior Art

Time delay depository safes designed to provide hold-up protection are widely employed in commercial environments. These safes typically utilize a door protected with a combination lock in conjunction with an overriding electronic or mechanical time delay mechanism. While these safes provide protection in the event of a hold-up, a drawback associated with them is that the combination lock provides a convenient method by which employees, in order to save time in reopening the safe door, can breach the security of the system by closing the safe door without scrambling the setting of the combination lock. In this mode a turn of the door handle will gain access to the contents of the safe and thus defeat the total security of the safe.

To obviate this drawback, one current practice is to add a conventional slam lock to the system which will engage if the door is closed. The slam lock then becomes the only locking element of the system protecting the safe, bypassing the higher security combination lock and boltwork mechanism. Since the lock and, in most cases, the boltwork mechanism are the UL, insurance and/or bank rated security elements, with these in a bypassed mode the safe no longer is effective as a rated unit and thus reverts to a level of no relative security value or protection. The slam lock is therefore an unacceptable back-up in that it negates the security rating of the safe, rendering it ineffective for the purpose intended. Also, the slam lock is an added expense that affects the profitability of the business, hence very few commerical safes are equipped with them.

Managers of commercial establishments using these safes must constantly cope with the problem of excessive training and supervision to assure that the safe door is locked and that the combination has been scrambled. Also, because of the risks involved, some companies have imposed a policy of immediate dismissal of the responsible employee when an unlocked condition is discovered. This policy is not a desirable solution in that it results in increased expenditures for hiring and training of new personnel.

Many safes also typically utilize doors mounted by by hinge arrangements which require disassembly of internal and external portions of the housing of the safe in order to remove the door. As a result, removal of the door can take several hours which increases the expenditures for service and maintenance of the safes.

Consequently, a need still exists for improvements in safe door mounting and locking so as to overcome the drawbacks of the prior art.

SUMMARY OF THE INVENTION

The present invention provides a security safe having improved door mounting and locking features designed to overcome the above-described drawbacks and satisfy the aforementioned need. The advantages of the improved door mounting and locking features of the present invention can be realized by employing the improved features either together or separately in security safes.

The improved door mounting feature permits quick and easy removal and replacement of the safe door after being opened. The improved door locking feature disciplines and enhances security by virtue of being self-locking and combination scrambling automatically, without operator assistance, to thereby prevent the safe door from being closed without being locked. These improved features thus establish a new and higher level of security and maintainability of safes, accompanied by corresponding reduction in training, supervisory and service expenses.

Accordingly, the present invention is directed to a security safe including a housing defining an interior storage cavity and having an annular portion defining an opening to the cavity, a door mounted to the annular portion of the housing for movement between opened and closed positions relative to the opening and having opposite exterior and interior sides with the interior side facing the interior cavity in the closed position of the door, and a lock and boltworks mechanism mounted on the door. The lock and boltworks mechanism comprises: (a) a plurality of lock members mounted on the interior side of the door in spaced apart relation from one another and adjacent to the annular portion of the housing and being slidably movable between locked and unlocked positions with respect to the annular portion; (b) means on the door operable for converting between locked and unlocked conditions; (c) a coupler member connected to the converting means being mounted on the interior side of the door and reciprocally and linearly movable between first and second displaced positions, the coupler member being movable from the first to second displaced position in response to the operable means converting from the locked to unlocked condition, the coupler member interconnecting the lock members to undergo concurrent movement between the locked and unlocked positions in response to coupler member undergoing linear movement between the first and second displaced positions; and (d) means mounted on the interior side of the door for causing movement of the coupler member from the second displaced position to the first displaced position in response to the door moving from the opened to closed position.

Also, the present invention is directed to a security safe including a housing defining an interior storage cavity having an opening, a door mounted to the housing for movement between opened and closed positions relative to the opening and having an interior side facing the interior cavity in the closed position of the door, and a mounting arrangement for releasably and movably mounting the door to the housing. The door mounting arrangement comprises: (a) a pair of corner portions on the door each having an elongated bore defined therein being open at a peripheral edge thereof; (b) a pair of corner segments on the housing each being disposed adjacent to one of the corner portions on the door and having an elongated hole defined in the corner segment being open at a peripheral edge thereof and aligned with the bore defined in the one corner portion of the door; (c) a pair of elongated hinge members each being slidably mounted in one of the bores for movement between a door mounting position in which the respective hinge member projects into the hole in the one corner segment of the housing aligned with the one bore so as to pivotally couple the door to the housing and a door releasing position in which the respective hinge member is withdrawn from the hole in the one corner segment aligned with the one bore so as to uncouple the door from the housing to permit removal of the door from the housing; and (d) means at the respective corner portions of the door for accessing the hinge members from the interior side of the door in order to slidably move the hinge members from the door mounting to door releasing positions.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

In General

Figure 1:
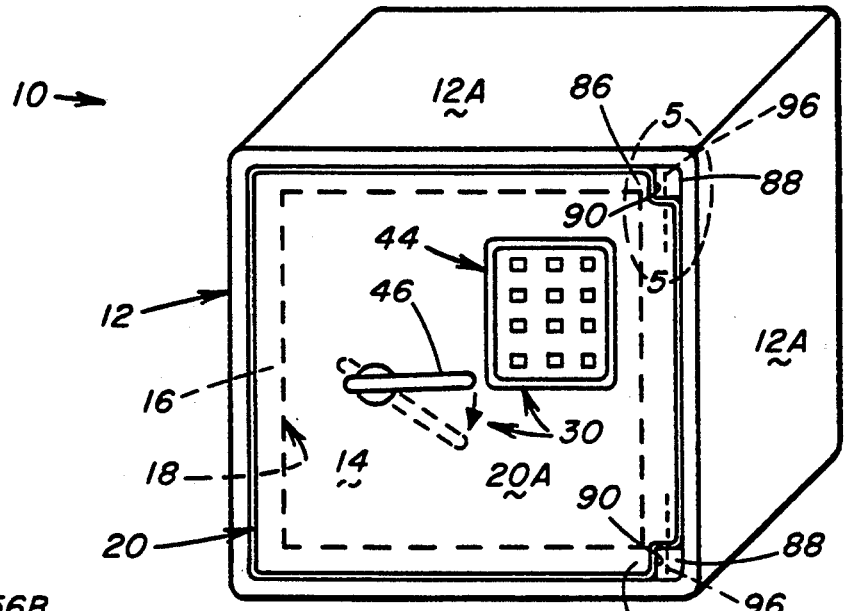
FIG. 1 is a perspective view of a security safe incorporating the improvements of the present invention.

Referring to the drawings, and particularly to FIG. 1, there is illustrated a security safe, generally designated 10, incorporating the improved features of the present invention. The security safe 10 include a housing 12 having a plurality of walls 12A interconnected together in a generally rectangular configuration and defining an interior storage cavity 14. The walls 12A of the housing 12 define an annular portion 16, for example a front or top annular portion depending upon whether the safe 10 is an upright model or an in-the-floor model installed in concrete. The annular portion 16 defines an opening 18 to the storage cavity 14.

The security safe 10 also includes a door 20 mounted to the annular portion 16 of the housing 12 for movement between opened and closed positions relative to the opening 18. The door 20 has opposite exterior and interior sides 20A, 20B. The interior side 20B of the door faces the interior storage cavity 14. In accordance with the principles of the present invention, the safe 10 also includes an improved lock and boltworks mechanism 22 and an improved door mounting arrangement 24.

Improved Lock and Boltworks Mechanism

Figure 2:
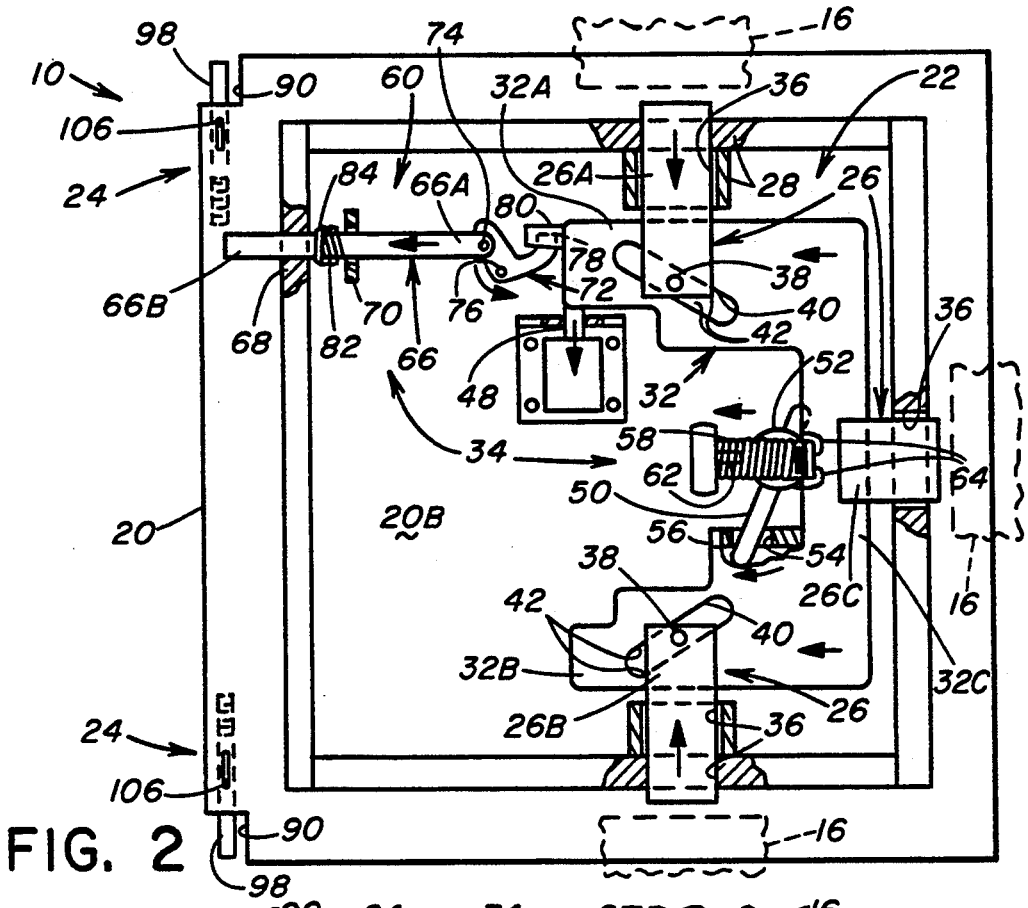
FIG. 2 is an elevational view of a rear side of the door of the security safe of FIG. 1, showing an improved lock and boltworks mechanism of the present invention in an unlocked condition.
Figure 3:
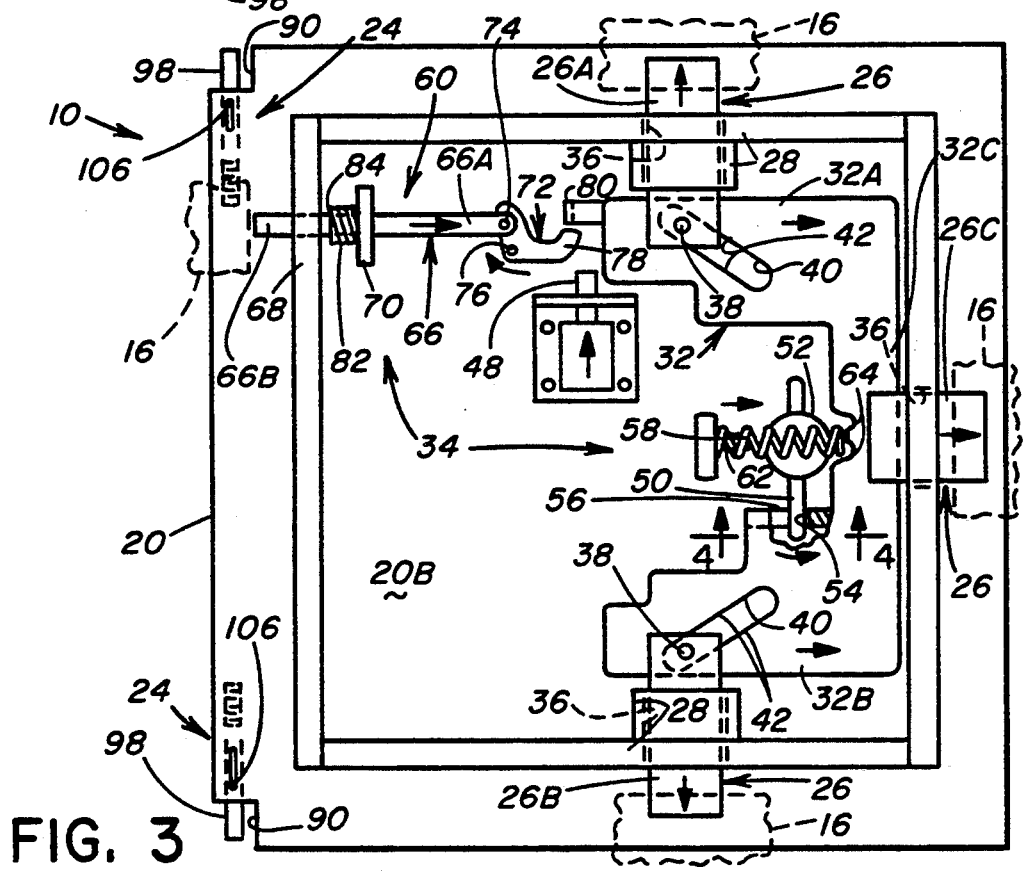
FIG. 3 is a view similar to FIG. 2, but showing the improved lock and boltworks mechanism of the present invention in a locked condition.

Referring to FIGS. 1–3, the improved lock and boltworks mechanism 22 includes a plurality of slidable lock members 26 and a plurality of guide structures 28 for the lock members 26. The mechanism 22 also includes means 30 operable for converting the door 20 between locked and unlocked conditions, a coupler member 32 for moving the lock members 26, and means 34 for causing the coupler member 32 to move in response to the door 20 moving from the opened to closed position.

Referring to FIGS. 2 and 3, the lock members 26 of the lock and boltworks mechanism 22, which are commonly referred to as door lock bolts, are disposed on the interior side 20B of the door 20 in spaced apart relation from one another about and adjacent to the annular portion 16 of the housing 12 when the door 20 is in its closed position. The guide structures 28 are attached on the interior side 20B of the door 20 adjacent to the annular portion 16 of the housing 12 when the door 20 is in its closed position. The guide structures 28 are disposed in spaced apart relation from one another corresponding to the desired spaced apart relation of the lock members 26 from one another. The guide structures 28 define guide passages 36 which slidably receive and support the respective lock members 26. The guide structures 28 support the lock members 26 for undergoing sliding linear movement between unlocked and locked positions, being shown respectively in FIGS. 2 and 3. To reach the unlocked positions of FIG. 2 in which the lock members 26 are retracted away from interfitted relations with the annular portion 16 of the housing 12, the lock members 26 are slidably moved relative to the guide structures 28 inwardly away from the annular portion 16. To reach the locked positions of FIG. 3 in which the lock member 26 are extended into interfitted relations with the annular portion 16 of the housing 12, the lock members 26 are slidably moved relative to the guide structures 28 outwardly toward the annular portion 16.

The coupler member 32 of the lock and boltworks mechanism 22 is mounted on the interior side 20B of the door 20 for undergoing linear movement between first and second displaced positions, being shown respectively in FIGS. 3 and 2. The coupler member 32 is disposed between and interconnects the respective lock members 26 such that the lock members 26 undergo concurrent movement between their respective locked and unlocked positions in response to the coupler member undergoing linear movement between its first and second displaced positions. Preferably, the coupler member 32 has a generally U-shaped configuration and includes a pair of side portions 32A, 32B and an end portion 32C extending between and interconnecting the side portions 32A, 32B.

Preferably, there are three lock members 26. The side portions 32A, 32B of the coupler member 32 are connected with first and second ones 26A, 26B of the lock members 26, whereas the end portion 32C of the coupler member 32 is connected to a third one 26C of the lock members 26. The connections of the side portions 32A, 32B of the coupler member 32 with the first and second lock members 26A, 26B are such that the direction of linear movement of the side portions 32A, 32B of the coupler member 32 between first and second displaced positions is generally tranverse to the direction of movement of the first and second lock members 26A, 26B between their locked and unlocked positions. In particular, the side portions 32A, 32B of the coupler member 32 are pivotally connected to the first and second lock members 26A, 26B by respective pins 38 fastened to the first and second lock members 26A, 26B extending through respective elongated slots 40 defined in the side portions 32A, 32B of the coupler member 32. The slots 40 are defined by pairs of spaced apart surfaces 42 formed in the interior of the coupler member 32 to extend at substantially equal and opposite acute angles, such as about forty-five degrees, to the generally transverse directions of linear movements of the coupler member 32 and first and second lock members 26A, 26B. The pairs of spaced surfaces 42 thereby provide camming actions in opposite directions against the pins 38 attached to the first and second lock members 26A, 26B for causing corresponding movement thereof as the coupler member 32 undergoes linear movement between its first and second displaced positions.

On the other hand, the connection of the end portion 32C of the coupler member 32 to the third lock member 26C is such that the direction of linear movement of the end portion 32C of the coupler member 32 is generally parallel to the direction of movement of the third lock member 26C. This is due to the fact that the end portion 32C of the coupler member 32 is rigidly connected to the third lock member 26C such that the third lock member 26C and the coupler member 32 move in unison with one another.

The connecting relations between the coupler member 32 and the three lock members 26A, 26B, 26C, as described above, provides a floating mounted relationship of the coupler member 32 to the door 20 which is self-aligning and does not require additional guiding structures. As a result, the general tolerances needed to be observed in construction of the coupler member 32 and door 20 are not as close.

The operable means 30 on the door 20 for converting the door 20 between locked and unlocked conditions includes a lock mechanism 44 and a handle member 46 mounted on the exterior side 20A of the door, and a retaining member 48 and a link 50 mounted on the interior side 20B of the door 20. The lock mechanism 44, as illustrated, preferably is an electronic combination lock; however, alternatively a keylock or mechanical combination lock could be employed. The handle member 46 is mounted on a shaft 52 extending through the door 20 and rotatable relative to the door 20 for pivotally moving the handle member 46 between latched and unlatched positions, respectively illustrated in solid and dashed line forms in FIG. 1. The lock mechanism 44 and handle member 46 are thus manipulated in a known manner to convert the door 20 between locked and unlocked conditions.

The handle member 46 is movably connected to the coupler member 32, via the link 50 attached to the shaft 52 and a hole 54 in a flange 56 on the coupler member 32, such that the coupler member 32 moves between the first and second linearly displaced positions in response to pivotal movement of the handle member 46 between the latched and unlatched positions. The operation of the retaining member 48 is controlled by the state of the lock mechanism 44. When the lock mechanism 44 converts the door 20 to the locked condition, the retaining member 48 is movably extended to a blocking position, as seen in FIG. 3, in which it is projected into the path of movement of the one side portion 32A of the coupler member 32 and thereby prevents the coupler member 32 from being moved from its first to second displaced position. When the lock mechanism 44 converts the door 20 to the unlocked condition, the retaining member 48 is movably retracted, as seen in FIG. 2 to an unblocking position, as seen in FIG. 2, in which it is withdrawn from the path of movement of the coupler member 32 and thereby permits the coupler member 32 to be moved from its first to second displaced position. Thus, withdrawal of the retaining member 48 from its blocking to unblocking position upon converting of the door 20 from its locked to unlocked condition by the lock mechanism 44, permits pivoting of the handle member 46 from its latched to unlatched positions and thereby movement of the coupler member 32 from its first to second displaced positions so as to cause retraction of the lock members 26 from their locked to unlocked positions.

Figure 4:
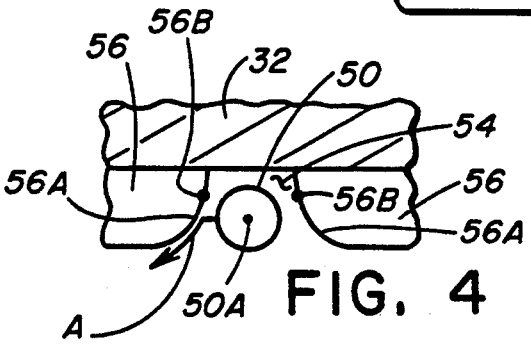
FIG. 4 is an enlarged fragmentary view taken along line 4—4 of FIG. 3.

Referring to FIG. 4, to prevent forcing of the handle 46 and coupler member 32 so as to fracture the retainer member 48 and gain unauthorized entry to the safe 10, the opposite edges 56A of the flange 56 at the hole 54 are rounded off. Each rounded edge 56A extends along a radius beginning at a point 56B located above the center 50A of the link 50 such that forcing of the link beyond the point of contact with the flange 56 will cause the link to raise slightly the coupler member 32 and ride under it along the path of the arrow A in FIG. 4. This feature prevents damage to the parts while permitting resetting merely by return of the handle 46 to its normal position.

For causing movement of the coupler member 32 from its second to first displaced position and thereby extension of the lock members 26 from their unlocked to locked positions in response to closing of the door 20, the means 34 includes a return spring 58 and a latch mechanism 60 being mounted on the interior side 20B of the door 20. The return spring 58 is mounted on and anchored to a pedestal 62 rigidly attached on the interior side 20B of the door 20 at a location aligned with and spaced from the one of the guide structures 28 which slidably supports the third lock member 26C and spaced from the handle shaft 52 opposite from the third lock member 26C. The return spring 58 extends over the handle shaft 52 and seats at an opposite end in a notch 64 defined in the end portion 32C of the coupler member 32 so as to bias the coupler member 32 to move from the second position thereof of FIG. 2 toward the first position thereof of FIG. 3. and thereby bias the lock members 26 to move from their unlocked to locked positions thereof.

The latch mechanism 60 is operable to override the biasing effect of the return spring 58 by latching and holding the coupler member 32 at its second position of FIG. 2 and thus retain the lock members 26 at their unlocked positions, until the door 20 is returned to its closed position. The latch mechanism 60 includes an elongated actuating member 66 mounted on the interior side 20B of the door 20 through aligned openings in a pair of structures 68, 70 affixed on the door 20. The actuating member 66 is slidably mounted by the structures 68, 70 to undergo linear movement relative to the coupler member 32 between actuated and deactuated positions, as shown respectively in FIGS. 2 and 3. The latch mechanism 60 also includes a latching member 72 pivotally connected at 74 to an inner end 66A of the actuating member 66 and pivotally mounted on the interior side 20B of the door 20 by a stationary pivot element 76 for undergoing pivotal movement betwen latched and unlatched positions relative to the coupler member 32 in response to linear movement of the actuating member 66 between the actuated and deactuated positions thereof. In the latched position, a catch 78 on the pivotal latching member 72 interengages a tab 80 fixed to the coupler member 32 so as to prevent the coupler member 32 from moving from its second displaced position of FIG. 2 to its first displaced position of FIG. 3 and thereby prevent the lock members 26 from moving from their unlocked to locked positions. A biasing spring 82 captured between the one structure 70 and a ring 84 attached on and carried by the actuating member 66 biases the actuating member 66 to its actuated position shown in FIG. 2.

When the opposite outer end 66B of the actuating member 66 is contacted by the annular portion 16 of the housing 12 upon swinging of the door 20 to its closed position, the actuating member 66 is moved toward the coupler member 32 and causes the latching member 72 to pivot clockwise and withdraw and disengage its catch 78 from the tab 80 on the coupler member 32 so as to release the coupler member 32 and permit it to then move from its second displaced position of FIG. 2 to its first displaced position of FIG. 3, under the influence of the force of the return spring 58, and thereby cause the lock members 26 to move from their unlocked to locked positions.

Whereas the prior art security safe construction required the operation of a handle to lock the boltworks of the safe, the improved lock and boltworks mechanism 22 of the present invention thus requires no movement of the handle. Instead, the safe 10 will automatically lock and the combination scramble upon closing of the door 20 and moreover the locking is achieved without resort to a slam lock type feature which adversely affects the security rating of the safe. The U-shaped configuration of the coupler member 32 and respective spaced arrangement and connection of the lock members 26A, 26B, 26C about its periphery eliminates a central location of mounting and rotation as in the case of a prior art circular cam used to move the lock members. The provision of the U-shaped coupler member 32 disperses the points of attack required for successfully making unauthorized penetration of the locking system of the safe 10 and thereby heightens security.

Improved Door Mounting Arrangement

Figure 5:
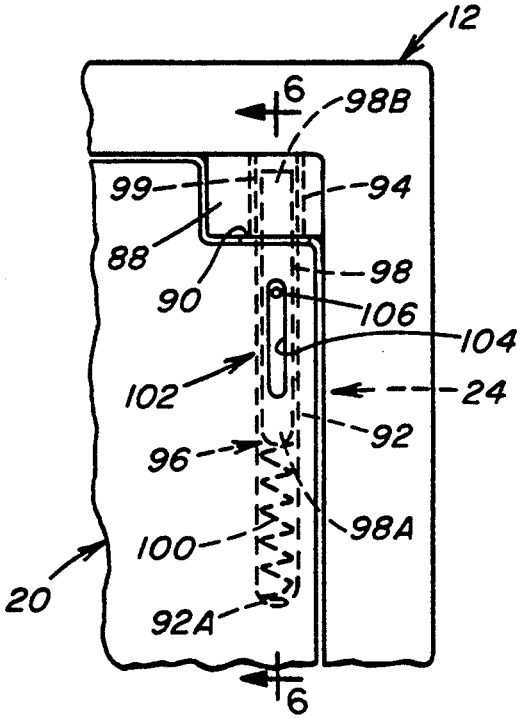
FIG. 5 is a fragmentary enlarged view of the portion of the security safe encircled by oval 5—5 in FIG. 1, showing one of the improved door mounting and releasing arrangement of the present invention.
Figure 6:
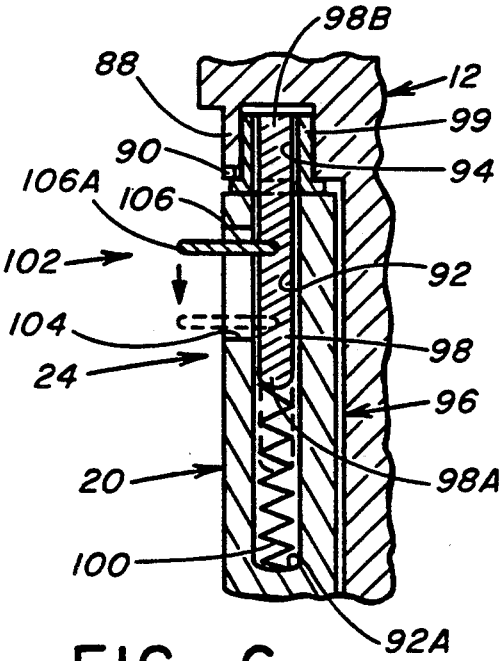
FIG. 6 is a sectional view of the improved door mounting and releasing arrangement taken along line 6—6 of FIG. 5.

Referring to FIGS. 1, 5 and 6, the improved door mounting arrangement 24 includes a pair of corner portions 86 on the door 20 and a pair of corner segments 88 on the housing 12. Each corner portion 86 defines a cutout 90 in the door 20 and has an elongated bore 92 defined therein being open at a peripheral edge of of the corner portion 86 defining the cutout 90. Each corner segment 88 is in the form of a block rigidly attached on the housing 12 adjacent to and disposed in the cutout 90 at one of the corner portions 86 on the door 20. Each block 88 has an elongated hole 94 defined therein being open at a peripheral edge of the block 88 and aligned with the respective bore 92.

The door mounting arrangement 24 also includes a pair of elongated hinge members 96. Each hinge member 96 includes a cylindrical pin 98 slidably mounted in a respective bore 92 for movement between door mounting and releasing positions, and a spring 100 disposed in the bore 92 between an inner end 92A of the bore and an inner end portion 98A of the pin 98. The spring 100 biases the pin 98 for sliding movement toward the door mounting position, as seen in FIGS. 5 and 6, in which an outer end portion 98B of the pin 98 projects from the bore 92 and into the hole 94 in the block 88 aligned with the bore 92 so as to pivotally couple the door 20 to the housing 12. A replaceable bearing sleeve 99 in the shaped of a top hat is disposed in the hole 94 and within the clearance between the door 20 and housing 12 to provide a bearing and wear surface which can be removed manually without use of tools.

The door mounting arrangement 24 further includes means 102 for accessing the hinge members 96 from the interior side 20B of the door 20 at the respective corner portions 86 thereof to slidably move the hinge members 96 from the door mounting positions shown in solid line in FIG. 6 to door releasing positions shown in dashed line in FIG. 6, without the use of tools and without first having to disassembly any portion of the housing 12. The accessing means 102 includes a slot 104 defined in each of the corner portions 86 of the door 20 extending between the bore 92 and the interior side 20B of the door 20 and being aligned with the bore 92, and a handle 106 attached to each pin 98 and extending in a generally transverse relation therefrom through a respective one of the slots 104. The handle 106 has an outer end 106A projecting from the interior side 20B of the door so as to be capable of being gripped by a person's fingers to slidably move the respective hinge pin 98 to the door releasing position in which the outer end 98B of the respective hinge pin 98 is withdrawn from the hole 104 in the one corner segment block 88 aligned with the one bore 92 so as to uncouple the door 20 from the housing 12 to permit removal of the door 20 from the housing 12. Additionally, the extension of the handle 106 through the slot 104 prevents axial rotation of the hinge pin 98 such that wear occurs at the replaceable bearing sleeve 99 and not at the pin 98 and door 20.

Whereas the prior art security safe construction required the disassembly of a portion of the housing of the safe to remove the door, the improved door mounting arrangement 24 of the present invention requires that no tools be used nor the removal of any parts of the safe. Instead, the door 20 of the safe 10 only needs to be opened to be removed.

It is thought that the present invention and its advantages will be understood from the foregoing description and it will be apparent that various changes may be made thereto without departing from its spirit and scope of the invention or sacrificing all of its material advantages, the form hereinbefore described being merely preferred or exemplary embodiment thereof.

Having thus described the invention, what is claimed is:

1. A security safe including a housing defining an interior storage cavity and having an annular portion defining an opening to said cavity, a door mounted to said annular portion of said housing for movement between opened and closed positions relative to said opening and having opposite exterior and interior sides with said interior side facing toward said interior cavity in said closed position of said door, and a lock and boltworks mechanism mounted on said door, said lock and boltworks mechanism comprising:

(a) a pair of first and second lock members disposed on said interior side of said door in spaced apart relation to and aligned opposite from one another and adjacent to opposite sides of said annular portion of said housing in said closed position of said door and being slidably movable toward and away from said annular portion between locked and unlocked positions with respect to said annular portion;

(b) a third lock member disposed on said interior side of said door in spaced apart relation to and offset from said first and second lock members and adjacent to an end of said annular portion of said housing extending between said opposite sides of said annular portion in said closed position of said door and being slidably movable toward and away from said annular portion between locked and unlocked positions with respect to said annular portion;

(c) means mounted on said door operable for converting said door between locked and unlocked conditions;

(d) means mounted on said interior side of said door adjacent to said opposite sides and said end of said annular portion of said housing in said closed position of said door and at positions corresponding to said first, second and third lock members for defining guide passages slidably receiving said respective lock members and supporting said lock members for linear movement toward and away from said annular portion between locked and unlocked positions with respect to said annular portion;

(e) a coupler member connected to said converting means and mounted on said interior side of said door, said coupler member being linearly movable between first and second displaced positions, said coupler member being movable from said first to second displaced position in response to said operable means converting from said locked to unlocked condition, said coupler member interconnecting said lock members such that said lock members undergo concurrent movement between said locked and unlocked positions in response to said coupler member undergoing linear movement between said first and second displaced positions, said coupler member having a substantially U-shaped configuration formed by a pair of side portions and an end portion extending between and interconnecting said side portions, said side portions of said coupler member being slidably connected to said first and second lock members such that said first and second lock members move in a direction generally transverse to the direction of linear movement of said side portions of said coupler member as said coupler member moves between said first and second displaced positions, said end portion of said coupler member being fixedly connected to said third one of said lock members such that said third lock member is centrally-located and equidistantly spaced from the first and second lock members and moves in the same direction and in unison with said end portion of said coupler member as said coupler member moves between said first and second displaced positions, said coupler member being movably mounted to said door and in a self-aligning relationship with respect to said lock members solely because of said respective slidably and fixedly connected relationships of said coupler member with said lock members in which said coupler member is guided by said means for guiding said third lock member solely because of said fixedly connected relationship of said coupler member with said third lock member, said converting means including a handle member mounted on said exterior side of said door for undergoing pivotal movement between unlatched and latched positions and being connected to said coupler member such that said coupler member is movable between said first and second linearly displaced positions in response to pivotal movement of said handle member between said latched and unlatched positions; and (f) means mounted on said interior side of said door for causing movement of said coupler member from said second displaced position to said first displaced position in response to said door moving from said opened to closed position, said means for causing movement of said coupler member including a support member stationarily mounted on said interior side of said door in spaced relation from said transverse end portion of said coupler member and in alignment with said third lock member, said means for causing movement of said coupler member also including a spring mounted along said interior side of said door between and engaged with said support member and said transverse end portion of said coupler member and aligned with said third lock member, said spring being biased to extend and cause said coupler member to move from said second displaced position toward said first displaced position thereof and thereby said lock members to move from said unlocked positions toward said locked positions thereof, said spring being yieldably compressible in response to said handle being moved from said latched to unlatched position.

2. The mechanism of claim 1 further comprising:

a plurality of guide structures mounted on said interior side of said door adjacent to said annular portion of said housing in said closed position of said door and in spaced apart relation from one another corresponding to said spaced apart relation of said lock members from one another, said guide structures defining guide passages receiving said respective lock members and supporting said lock members for linear movement toward and away from said annular portion of said housing.

3. The mechanism of claim 1 wherein said lock members in said unlocked positions are retracted inwardly away from said annular portion of said housing and in said locked positions are extended outwardly toward said annular portion of said housing.

4. The mechanism of claim 3 wherein said lock members in said unlocked positions are retracted inwardly away from an interfitted relation with said annular portion of said housing and in said locked positions are extended outwardly toward and into the interfitted relation with said annular portion of said housing.

5. The mechanism of claim 1 wherein said side portions of said coupler member are connected to said first and second lock members by respective elongated slots defined in said coupler member by pairs of spaced surfaces extending at acute angles to the direction of linear movement of said coupler member and to the direction of movement of said lock members such that said surfaces provide a camming action against said lock members for causing said movement thereof as said coupler member undergoes said linear movement.

6. The mechanism of claim 1 wherein said operable means for converting said door between locked and unlocked conditions includes a retaining member mounted on said interior side of said door and being movable, in response to converting of said door between said locked and unlocked conditions, between blocking and unblocking positions in which said coupler member is respectively prevented and permitted to move from said first and second displaced positions.

7. The mechanism of claim 1 wherein said means for causing movement of said coupler member from said second to first displaced position in response to said door moving from said opened to closed position further includes:

an actuating member mounted on said interior side of said door for undergoing linear movement relative to said coupler member between actuated and deactuated positions; and a latching member pivotally mounted on said interior side of said door for undergoing pivotal movement between latched and unlatched positions relative to said coupler member in response to linear movement of said actuating member between said actuated and deactuated positions such that said latching member in said latched position prevents said coupler member from moving from said second to first displaced position and thereby said lock members from moving from said unlocked to locked positions, whereas said latching member in said unlatched position releases said coupler member and permits said coupler member to move from said second to first displaced position and thereby said lock members to move from said unlocked to locked positions.

8. A security safe including a housing defining an interior storage cavity and having an annular portion defining an opening to said cavity, a door mounted to said annular portion of said housing for movement between opened and closed positions relative to said opening and having opposite exterior and interior sides with said interior side facing toward said interior cavity in said closed position of said door, and a lock and boltworks mechanism mounted on said door, said lock and boltworks mechanism comprising:

(a) a pair of first and second lock members disposed on said interior side of said door in spaced apart relation to and aligned opposite from one another and adjacent to opposite sides of said annular portion of said housing in said closed position of said door;

(b) a third lock member disposed on said interior side of said door in spaced apart relation to and offset from said first and second lock members and adjacent to an end of said annular portion of said housing extending between said opposite sides of said annular portion in said closed position of said door;

(c) first, second and third guide structures mounted on said interior side of said door adjacent to said annular portion of said housing in said closed position of said door and in spaced apart relation from one another corresponding to said spaced apart relation of said first, second and third lock members from one another, said guide structures defining guide passages slidably receiving said respective lock members and supporting said lock members for linear movement toward and away from said annular portion between locked and unlocked positions with respect to said annular portion;

(d) means on said door operable for converting said door between locked and unlocked conditions;

(e) a coupler member connected to said converting means and mounted on said interior side of said door, said coupler member being linearly movable between first and second displaced positions, said coupler member being movable from said first to second displaced position in response to said operable means converting from said locked to unlocked condition, said coupler member interconnecting said lock members such that said lock members undergo concurrent movement between said locked and unlocked positions in response to said coupler member undergoing linear movement between said first and second displaced positions, said converting means including a handle member mounted on said exterior side of said door for undergoing pivotal movement between unlatched and latched positions and being connected to said coupler member such that said coupler member is movable between said first and second linearly displaced positions in response to pivotal movement of said handle member between said latched and unlatched positions;

(f) said coupler member having a substantially U-shaped configuration formed by a pair of side portions and an end portion extending between and interconnecting said side portions, said side portions of said coupler member being slidably connected to said first and second lock members such that said first and second lock members move in a direction generally transverse to the direction of linear movement of said side portions of said coupler member as said coupler member moves between said first and second displaced positions, said end portion of said coupler member being fixedly connected to said third lock member such that said third lock member is centrally-located and equidistantly spaced from the first and second lock members and moves in the same direction and in unison with said end portion of said coupler member as said coupler member moves between said first and second displaced positions, said coupler member being movably mounted to said door and in a self-aligning relationship with resect to said lock members solely because of said respective slidably and fixedly connected relationships of said coupler member with said lock members in which said coupler member is guided by said third guide structure solely because of said fixedly connected relationship of said coupler member with said third lock member; and (g) means mounted on said interior side of said door for causing movement of said coupler member from said second displaced position to said first displaced position in response to said door moving from said opened to closed position, said means for causing movement of said coupler member including a support member stationarily mounted on said interior side of said door in spaced relation from said transverse end portion of said coupler member and in alignment with said third lock member, said means for causing movement of said coupler member also including a spring mounted along said interior side of said door between and engaged with said support member and said transverse end portion of said coupler member and aligned with said third lock member, said spring being biased to extend and cause said coupler member to move from said second displaced position toward said first displaced position thereof and thereby said lock members to move from said unlocked positions toward said locked positions thereof, said spring being yieldably compressible in response to said handle being moved from said latched to unlatched position.

9. The mechanism of claim 8 wherein said side portions of said coupler member are connected to said first and second lock members by respective elongated slots defined in said coupler member by pairs of spaced surfaces extending at acute angles to the direction of linear movement of said coupler member and to the direction of movement of said lock members such that said surfaces provide a camming action against said lock members for causing said movement thereof as said coupler member undergoes said linear movement.

10. The mechanism of claim 8 wherein said operable means for converting said door between locked and unlocked conditions includes a retaining member mounted on said interior side of said door and connected to said operable means, said retaining member being movable, in response to converting of said operable means between said locked and unlocked conditions, between blocking and unblocking positions in which said coupler member is respectively prevented and permitted to move from said first and second displaced position.

11. The mechanism of claim 8 wherein said means for causing movement of said coupler member from said second to first displaced position in response to said door moving from said opened to closed position further includes:

an actuating member mounted on said interior side of said door for undergoing linear movement relative to said coupler member between actuated and deactuated positions; and a latching member pivotally mounted on said interior side of said door for undergoing pivotal movement between latched and unlatched positions relative to said coupler member in response to linear movement of said actuating member between said actuated and deactuated positions such that said latching member in said latched position prevents said coupler member from moving from said second to first displaced position and thereby said lock members from moving from said unlocked to locked positions, whereas said latching member is said unlatched position releases said coupler member and permits said coupler member to move from said second to first displaced position and thereby said lock members to move from said unlocked to locked positions.

12. A security safe including a housing defining an interior storage cavity and having an annular portion defining an opening to said cavity, a door mounted to said annular portion of said housing for movement between opened and closed positions relative to said opening and having opposite exterior and interior sides with said interior side facing toward said interior cavity in said closed position of said door, and a lock and boltworks mechanism mounted on said door, said lock and boltworks mechanism comprising:

(a) a pair of first and second lock members disposed on said interior side of said door in spaced apart relation to and aligned opposite from one another and adjacent to opposite sides of said annular portion of said housing in said closed position of said door;

(b) a third lock member disposed on said interior side of said door in spaced apart relation to and offset from said first and second lock members and adjacent to an end of said annular portion of said housing extending between said opposite sides of said annular portion in said closed position of said door;

(c) means mounted on said interior side of said door adjacent to said annular portion of said housing in said closed position to said door for supporting and guiding said first, second and third lock members for linear movement toward and away from said annular portion between locked and unlocked positions with respect to said annular portion;

(d) a coupler member disposed on said interior side of said door and being linearly movable between first and second displaced positions, said coupler member having a substantially U-shaped configuration formed by a pair of said portions and an end portion extending between and interconnecting said side portions, said side portions of said coupler member being slidably connected to said first and second lock members such that said first and second lock members move in a direction generally transverse to the direction of linear movement of said side portions of said coupler member as said coupler member moves between said first and second displaced positions, said end portion of said coupler member being fixedly connected to said third lock member such that said third lock member moves in the same direction and in unison with said end portion of said coupler member as said coupler member moves between said first and second displaced positions, said coupler member being movably mounted to said door and in a self-aligning relationship with respect to said lock members solely because of said respective slidably and fixedly connected relationships of said coupler member with said lock members in which said coupler member is guided by said means for guiding said third lock member solely because of said fixedly connected relationship of said coupler member with said third lock member; and (e) mans on said door operable for converting said door between locked and unlocked conditions, said converting means including a handle member mounted on said exterior side of said door for undergoing pivotal movement between unlatched and latched positions, said handle member being connected to said coupler member such that said coupler member is movable between said first and second linearly displaced positions in response to pivotal movement of said handle member between said latched and unlatched positions, said coupler member interconnecting said lock members so as to provide a floating mounted relationship of said coupler member to said door which permits said coupler member to be displaced away from said door and remain stationary as said handle member is forcibly moved from said latched to unlatched position while said means on said door for converting said door between locked and unlocked conditions remains in said locked condition.

13. The mechanism of claim 12 wherein said guiding means includes a plurality of guide structures mounted on said interior side of said door adjacent to said annular portion of said housing in said closed position of said door and in spaced apart relation from one another corresponding to said spaced apart relation of said lock member from one another, said guide structures defining guide passages slidably receiving said respective lock members and supporting said lock members for linear movement toward and away from said annular portion between locked and unlocked positions with respect to said annular portion.

14. The mechanism of claim 14 wherein said side portions of said coupler member are connected to said first and second lock members by respective pins being fastened to said first and second lock members and extending through respective elongated slots defined in said side portions of said coupler member and extending at acute angles to said transverse directions of linear movements of said coupler member and said first and second lock members, said slots being defined by spaced surfaces formed in said coupler member side portions which provide camming actions in opposite directions against said pins attached to said first and second lock members.

* * * * *